US008234743B2

(12) United States Patent
Whisker

(10) Patent No.: US 8,234,743 B2
(45) Date of Patent: Aug. 7, 2012

(54) EXTENDABLE TOOTHBRUSH

(76) Inventor: William M Whisker, Niagara Falls, NY (US)

( * ) Notice: Subject to any disclaimer, the term of this patent is extended or adjusted under 35 U.S.C. 154(b) by 0 days.

(21) Appl. No.: 13/007,615

(22) Filed: Jan. 15, 2011

(65) Prior Publication Data

US 2012/0005851 A1 Jan. 12, 2012

Related U.S. Application Data

(60) Provisional application No. 61/362,308, filed on Jul. 8, 2010.

(51) Int. Cl.
*A46B 9/04* (2006.01)

(52) U.S. Cl. ..... 15/167.1; 15/176.1

(58) Field of Classification Search ..... 15/167.1, 15/176.1; *A46B 9/04*
See application file for complete search history.

(56) References Cited

U.S. PATENT DOCUMENTS

| | | | | |
|---|---|---|---|---|
| 2,517,029 | A | 8/1946 | Ridner | |
| 2,883,692 | A | 7/1957 | Kaye | |
| 4,866,809 | A | 9/1989 | Pelletir | |
| 5,005,246 | A | 4/1991 | Yen-Hui | |
| 5,400,457 | A * | 3/1995 | Ridgley | 15/167.1 |
| 7,055,205 | B2 * | 6/2006 | Aoyama | 15/172 |

* cited by examiner

*Primary Examiner* — Monica Carter
*Assistant Examiner* — Stephanie Newton
(74) *Attorney, Agent, or Firm* — Daniel Boudwin

(57) ABSTRACT

An extendable toothbrush for assisting a person with impaired mobility of the arms. The toothbrush has an extendable neck that locks in place at various lengths. The toothbrush is capable of extending to twice its retracted length, thus allowing a user to reach their mouth without having to raise their arm. Rotating head and brush implements further increase mobility and access to different areas of the mouth. A removable toothpick tool is attached to the handle of the toothbrush for cleaning in between teeth.

10 Claims, 2 Drawing Sheets

EXTENDABLE TOOTHBRUSH

CROSS REFERENCE TO RELATED APPLICATION

This application claims the benefit of U.S. Provisional Application No. 61/362,308 filed on Jul. 15, 2010, entitled "Intertooth Deluxe Cleaner".

BACKGROUND OF THE INVENTION

1. Field of the Invention

The present invention relates to an extendable toothbrush for assisting in brushing teeth with limited movement of the arms.

2. Description of the Prior Art

U.S. Pat. No. 2,517,029 to Ridner, U.S. Pat. No. 2,883,692 to Kaye, and U.S. Pat. No. 7,055,205 to Aoyama, each describe an extendable toothbrush with a hollow handle and a brush head that slides in and out of the handle. The object of each of these inventions is to provide a compact, portable toothbrush that can easily collapse for transport. None of the above mentioned patents attempt to provide an extendable toothbrush that allows a longer reach for brushing teeth, but rather they attempt the opposite—to provide a normal size toothbrush that can reduce its length for storage and transport.

U.S. Pat. No. 5,005,246 to Yen-Hui describes a toothbrush that has an extendable tongue cleaning attachment and a removable tongue scalar. Yen-Hui's toothbrush does not extend for brushing the teeth, but rather has an extendable tongue cleaning tool, which does not appear to have the requisite rigidity to act as a handle while brushing teeth.

U.S. Pat. No. 4,866,809 to Pelletir describes a telescopic toothbrush that is capable of dispensing toothpaste. Pelletir is unique in that the entire toothbrush is telescopic, as opposed to the present invention where a slidable neck extends the length of the toothbrush. Furthermore, Pelletire does not attempt to make the toothbrush telescopic for added reach, but rather as a means to dispense toothpaste from the handle.

SUMMARY OF THE INVENTION

In view of the foregoing disadvantages inherent in the known types of extendable toothbrushes now present in the prior art, the present invention provides a new extendable toothbrush wherein the same can be utilized for providing convenience for a user with reduced arm mobility when brushing their teeth.

It is therefore an object of the present invention to provide an extendable toothbrush that is capable of adjusting in length to a substantially longer length in order to accommodate users with reduced arm mobility, as well as to be easily transported in a compact carrying case. The extended length of the toothbrush measures roughly twelve inches longer than its retracted length and can be locked in place at small intervals, such as every inch.

Another object of the present invention is to provide a toothbrush head assembly that can rotate 360 degrees about the axis of the handle, thus making it easier to reach different angled surfaces in the mouth without having to rotate the wrist.

Yet another object of the present invention is to provide a toothbrush with a removable rubber pick attached to the handle for cleaning in between teeth.

Still another object of the present invention is to provide a toothbrush wherein the brushing heads can be removed and replaced at a low cost.

Other objects, features and advantages of the present invention will become apparent from the following detailed description taken in conjunction with the accompanying drawings.

BRIEF DESCRIPTIONS OF THE DRAWINGS

DETAILED DESCRIPTION OF THE INVENTION

Figure 1:
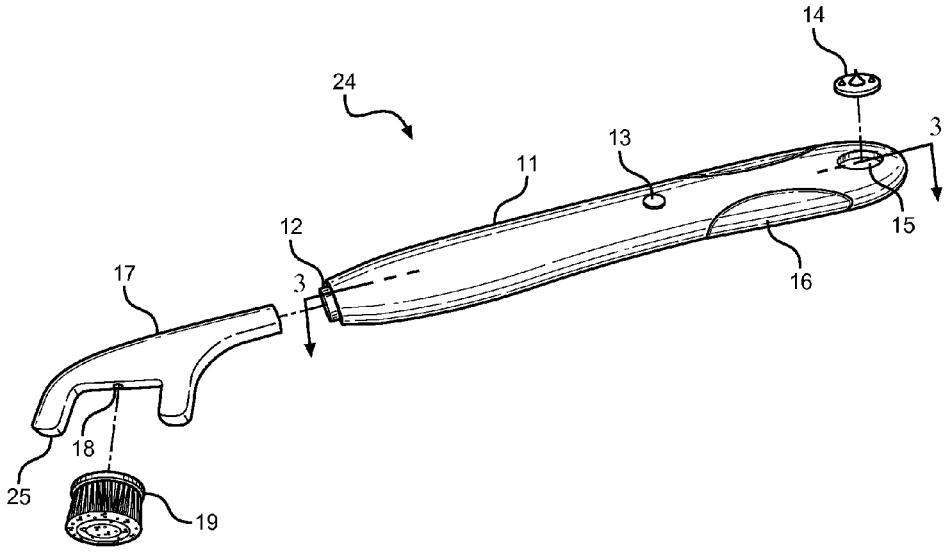
FIG. 1 Shows an exploded perspective view of the toothbrush with the neck fully retracted.

Referring now to FIG. 1, there is shown an exploded perspective view of the extendable toothbrush 24. The body 11 of the toothbrush is hollow and receives an extendable threaded neck 12, which is shown fully retracted. A soft grippable section 16 on the surface at the back end of the body can be gripped by the user. A pick implement 14 is removable from a recess 15 on the body. The head 17 of the toothbrush is removable from the neck and is snapped into place at its base. Once in place, the head 17 can rotate 360 degrees about the longitudinal axis of the neck 12. The head forms a generally "Y" shape with two prongs 25 at its top end. In the middle of the two prongs is a hole in the head that a brush element 19 can be snapped into. The brush implement 19 is also capable of rotating 360 degrees.

Figure 2:
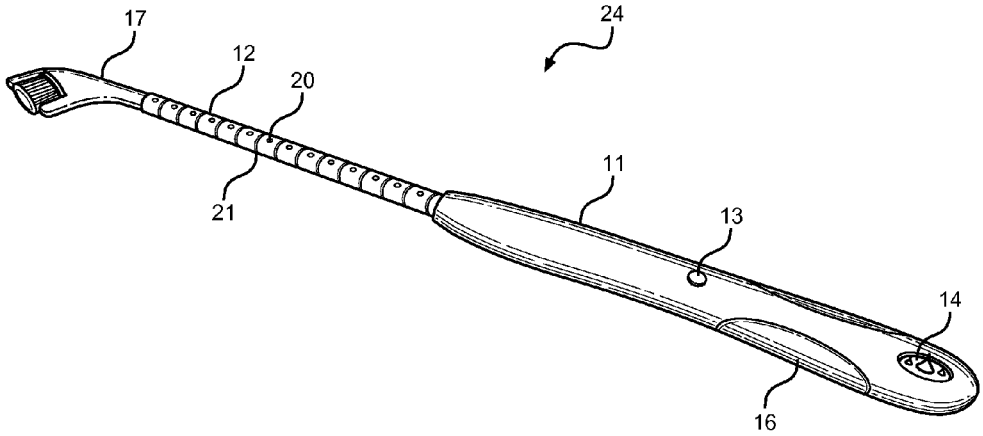
FIG. 2 Shows a perspective view of the toothbrush with the neck fully extended.
Figure 3:
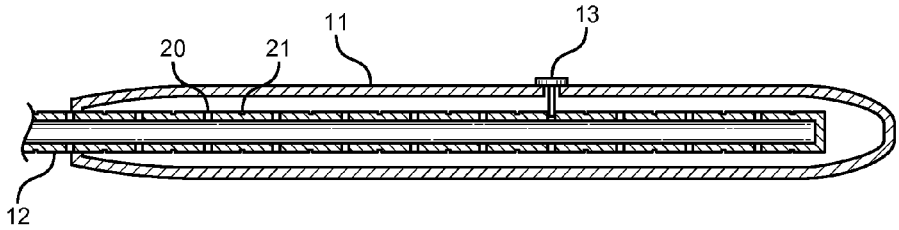
FIG. 3 Shows a cross sectional cut of the handle and head.

Referring now to FIG. 2, there is shown a perspective view of the toothbrush 24 with the neck 12 fully extended. The head 17 is shown attached to the neck 12 and the brush implement 19 is shown attached to the head 17. The pick implement 14 is shown pressed into the recess 15 on the body 11. The neck 12 is threadedly extendable from the body 11. Threads 21 are shown spanning the length of the neck 12. A button 13 on the body engages one of a plurality of holes 20 along the length of the neck. FIG. 3 shows a cross sectional view of the neck 12 retracted into the body 11. The button 13 is engaged with a hole 20 on the neck, locking the neck in place.

Figure 4:
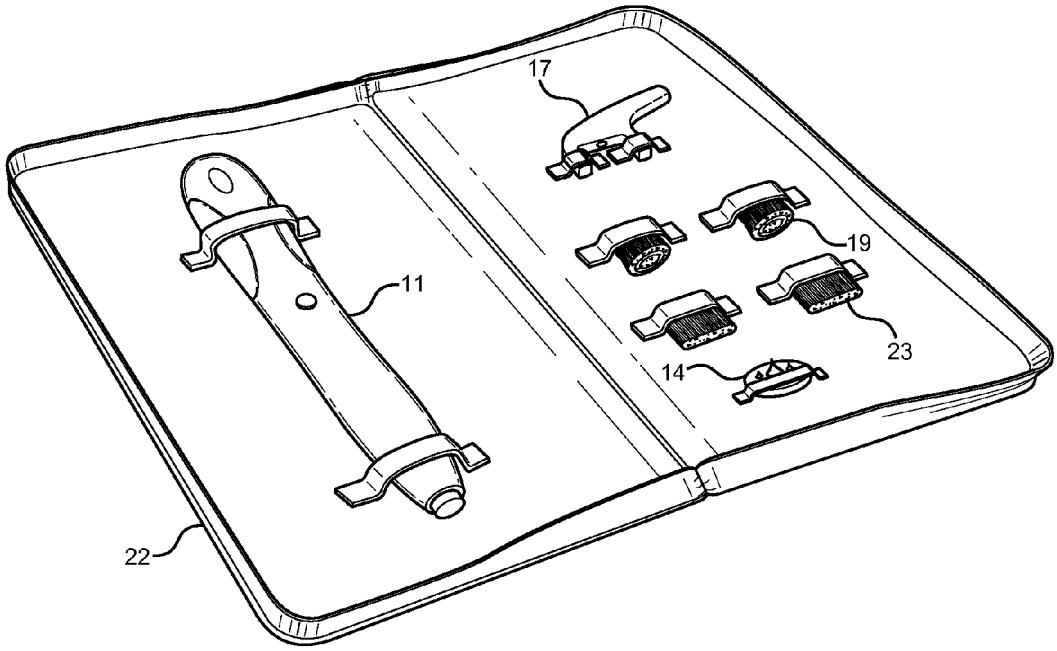
FIG. 4 Shows the carrying case with the toothbrush, head, brush attachments, and pick disconnected and stored separately.

FIG. 4 shows the toothbrush separated into its individual components and stored in a compact travel case 22. The case 22 is capable of carrying all necessary implements along with replacements. Different style brush implements can be used with the toothbrush. Examples of these include a circular brush 19 and a generally rectangular brush 23. Additional pick implements 14 can also be stored in the case 22. Each implements is designed to be separated from the toothbrush so as to be easily disposed of and replaced when worn down.

In use an individual will remove the toothbrush and implements from the carrying case and assemble them. The head is pushed into the hollow neck and the brush is pushed into the hole on the end of the head. The neck can be extended to a length that reaches the user's mouth with minimal arm movement. Both the head and brush will rotate to reach all areas of the mouth. The pick implement can be removed from the recess in the body and used to clean in between teeth.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An extendable toothbrush, comprising:

a handle, a threaded neck, a head attachment, and a head, wherein said threaded neck is threadedly inserted into said handle and locked in place at various lengths; said head attachment attaches to a second end of said threaded neck and is capable of rotating about said threaded neck; said head attachment having an inwardly curving prong disposed at first and second ends of said head attachment and a hole disposed between said prongs for attaching to said head, wherein said head has a plurality of bristles for brushing teeth.

2. The extendable toothbrush of claim one, where said head is detachable and disposable.

3. The extendable toothbrush of claim 1, further comprising:

a pick, wherein said pick is stored within a recess disposed along a side of said handle and directed laterally inward.

4. The extendable toothbrush of claim 1, wherein there is a plurality of said heads.

5. The extendable toothbrush of claim 4, wherein said plurality of heads comprises heads having different brush configurations.

6. An extendable toothbrush, comprising:

a handle;

a threaded neck;

a head attachment;

a head;

said threaded neck is threadedly inserted into said handle and locked in place at various lengths; said head attachment attaches to a second end of said threaded neck and is capable of rotating about said threaded neck; said head attachment having a hole for attaching to said head, wherein said head has a plurality of bristles for brushing teeth;

a pick, wherein said pick is stored within a recess disposed along a side of said handle and directed laterally inward.

7. The extendable toothbrush of claim 6, where said head is detachable and disposable.

8. The extendable toothbrush of claim 6, wherein there is a plurality of said heads.

9. The extendable toothbrush of claim 8, wherein said plurality of heads comprises heads having different brush configurations.

10. An extendable toothbrush, comprising:

a handle;

a threaded neck;

a head attachment;

a head;

said threaded neck is threadedly inserted into said handle and locked in place at various lengths; said head attachment attaches to a second end of said threaded neck and is capable of rotating about said threaded neck; said head attachment having an inwardly curving prong disposed at first and second ends of said head attachment and a hole disposed between said prongs for attaching to said head, wherein said head has a plurality of bristles for brushing teeth;

a pick, wherein said pick is stored within a recess disposed along a side of said handle and directed laterally inward.

* * * * *